US005790992A

United States Patent [19]

Ray

[11] Patent Number: 5,790,992

[45] Date of Patent: Aug. 11, 1998

[54] PORTABLE SHOWER

[76] Inventor: Tommy D. Ray, P.O. Box 538, Lakehills, Tex. 78063

[21] Appl. No.: 623,532

[22] Filed: Mar. 29, 1996

[51] Int. Cl.[6] ..... A47K 3/23

[52] U.S. Cl. ..... 4/599

[58] Field of Search ..... 4/599, 600, 602, 4/603; 135/91, 115, 117

[56] References Cited

U.S. PATENT DOCUMENTS

| | | | |
|---|---|---|---|
| 720,089 | 2/1903 | York . | |
| 1,049,714 | 1/1913 | Heizscovitz . | |
| 1,100,310 | 6/1914 | Lazarus et al. . | |
| 1,844,038 | 2/1932 | Hooker . | |
| 2,540,411 | 2/1951 | Wright . | |
| 3,391,409 | 7/1968 | Gatley | 4/602 |
| 3,925,828 | 12/1975 | Kim | 4/603 X |
| 4,719,935 | 1/1988 | Gustafoon | 135/94 X |
| 4,866,794 | 9/1989 | Davies . | |
| 5,205,001 | 4/1993 | O'Connell | 4/599 |
| 5,287,569 | 2/1994 | Johnson | 4/599 |
| 5,564,138 | 10/1996 | Simpson | 4/599 |
| 5,606,986 | 3/1997 | Muise | 135/91 X |

*Primary Examiner*—Charles E. Phillips
*Attorney, Agent, or Firm*—Stephen R. Greiner

[57] ABSTRACT

A portable shower for outdoor use. The shower is provided with a pyramidal frame and a cover on the frame. The cover includes: a curtain portion defining an opening adjacent the apex of the frame, a waterproof floor portion removably secured to the bottom of the curtain portion upon which a user may stand, and a transparent roof portion removably secured over the opening at the apex of the frame. A collapsible water bottle having a darkened exterior surface for absorbing solar energy may be supported by the frame adjacent the opening. Under the influence of gravity, sun-warmed water may be discharged from the bottle through a short hose for bathing purposes.

18 Claims, 1 Drawing Sheet

FIG. 1
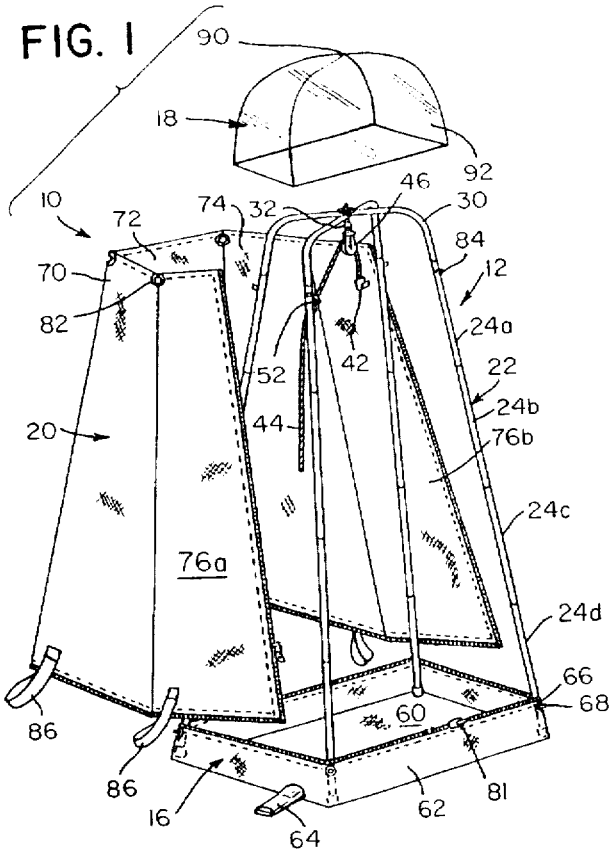
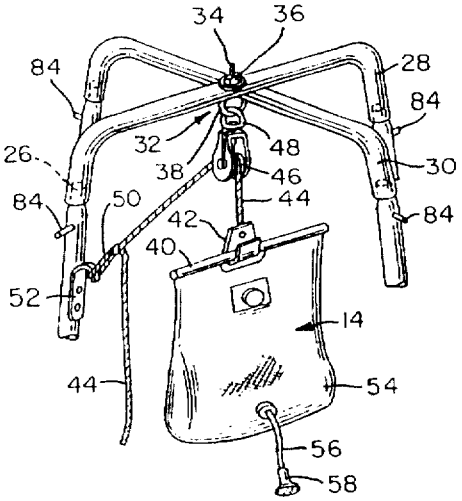
FIG. 4
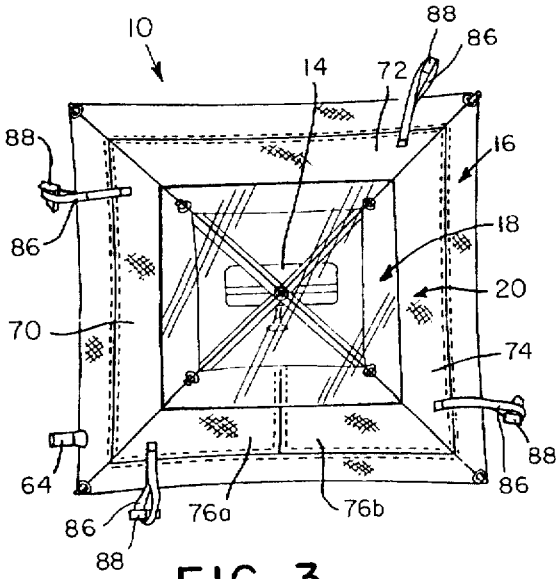
FIG. 3
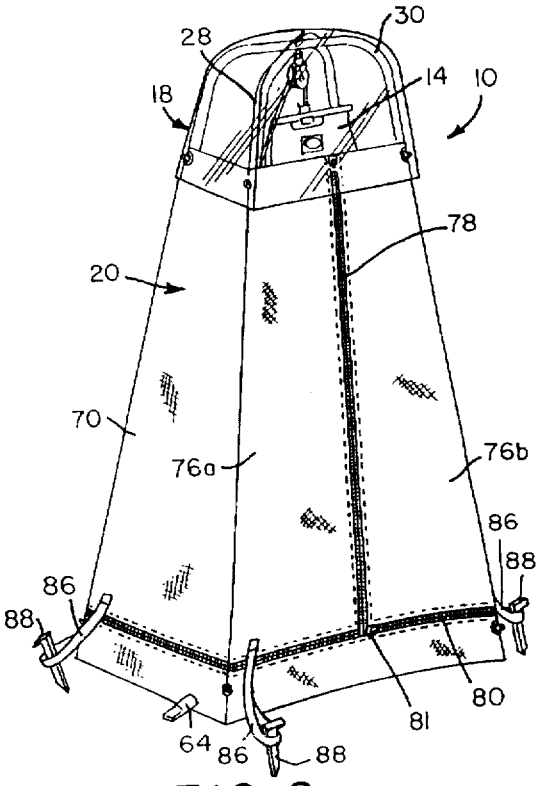
FIG. 2

PORTABLE SHOWER

FIELD OF THE INVENTION

The present invention relates generally to shower stalls with walls that are expansible for use and collapsible for subsequent transport, and storage.

BACKGROUND OF THE INVENTION

With the advent of solar hot water bottles, it is now possible to take a hot shower anywhere the sun happens to shine. As is well known, these bottles typically include a resilient bladder, molded from a dark-colored plastic, having a flexible outlet hose secured to its lower end. When exposed to direct sunlight, the bladder can absorb enough energy to warm several gallons of internally-stored water in a few hours. Thus, an individual on a camping trip, away from the comforts of home, need not choose between wasting scarce fuel to heat water on a camp stove for bathing or washing with chilly water.

Using solar water bottles for bathing is sometimes difficult. The water-holding bladder must be suspended above the bather so that its contents may be easily siphoned for use. In many modern camping areas, however, there are no accessible tree branches or other supports from which the bottle may be readily suspended. Also, on colder days, winds blowing over the exterior surface of the bladder may rob the bottle's contents of the heat gained from the sun thus greatly prolonging the warming period.

Tent-like shower structures, adapted to support a container of previously warmed water, have been proposed for private bathing in the outdoors. None is constructed, however, to rapidly warm water with energy from the sun. Additionally, many of these structures are open to the surrounding environment at their top or bottom. Thus, a bather may be chilled on even warm days by a breeze passing through the open structure. A need, therefore, exists for a structure which will conveniently and comfortably permit a user to bathe in the outdoors with solar heated water.

SUMMARY OF THE INVENTION

In light of the deficiencies of the portable showers which have been proposed in the past, it is a principal object of the invention to provide a collapsible structure for showering which will support a water bottle adapted to absorb solar energy in a position to receive rays proceeding from the sun and insulate the water bottle from the surrounding environment to minimize heat loss therefrom. By minimizing heat loss from the water bottle, the time required to heat its contents to a temperature sufficient for bathing is greatly reduced.

It is another object of the invention to provide a portable structure for showering which will fully enclose a user to maintain privacy and enhance comfort by separating the user from chilling winds, natural forms of precipitation and rocky or muddy soil surfaces.

It is a further object of the invention to provide a portable shower which can be easily erected without the use of tools of any type whenever bathing facilities are required.

It is an object of the invention to provide improved elements and arrangements thereof in a portable shower for the purposes described which is inexpensive, dependable and fully effective in accomplishing its intended purposes.

Briefly, the portable shower in accordance with this invention achieves the intended objects by featuring a generally pyramidal frame supporting a flexible cover. The cover includes: a curtain portion defining an opening adjacent the top of the frame, a waterproof floor portion secured by a zipper to the bottom of the curtain portion, and a transparent roof portion positioned over the opening. A solar hot water bottle may be supported by the frame adjacent the opening. During use, sun-warmed water may be discharged from the bottle through a short hose for bathing purposes.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which:

FIG. 1 is an exploded perspective view of a portable shower in accordance with the present invention, the solar hot water bottle being removed to permit examination of the shower's interior details.

FIG. 2 is a perspective view of the portable shower of FIG. 1 shown with the solar hot water bottle ready for use.

FIG. 3 is a top, plan view of the portable shower.

FIG. 4 is a perspective view of a portion of the shower frame illustrating details thereof.

Similar reference characters denote corresponding features consistently throughout the accompanying drawings.

DETAILED DESCRIPTION OF THE PREFERRED EMBODIMENT

Referring now to the FIGS., a portable shower in accordance with the present invention is shown generally at 10. The shower 10 is provided with a rigid frame 12 for supporting a solar hot water bottle 14 at a convenient height. For user comfort and privacy, the frame 12 is fully enclosed by a multi-part cover comprising: a floor portion 16, a transparent roof portion 18, and a curtain portion 20 positioned between the floor and roof portions.

The frame 12 includes four collapsible legs 22 arranged generally in the form of a pyramid. Each of the legs 22 comprises a plurality of tubular members 24*a–d* formed from a lightweight metal alloy such as aluminum. The upper end of each member 24*a–d* is provided with an integral, cylindrical fitting 26 of reduced outer diameter and adapted to be snugly received within the lower end of an adjacent member. Thus, the legs 22 may be assembled by simply mating four tubular members 24*a–d* together in axial alignment.

The top ends of the legs 22 themselves are secured to a cruciform top assembly by inserting the fittings 26 of the uppermost tubular members 24*a* into the downwardly turned ends of the two tubular members 28 and 30 comprising the top assembly. The members 28 and 30 are, in turn, connected together by an eyebolt 32 extending through their respective midpoints. As shown, the threaded portion 34 of the eyebolt 32 is retained in place by a nut 36 adjacent the upper member 28 whereas the loop portion 38 of the eyebolt 32 extends downwardly beneath the lower member 30.

The solar hot water bottle 14 is suspended by its handle 40 from a hook 42 secured to one end of a cable 44 entrained over a pulley 46. The pulley 46 is suspended from the eyebolt 32 by means of a swivel 48 secured within the loop portion 38 of the eyebolt. The cable 44 extends downwardly from the pulley 46 a distance sufficient to permit a user to conveniently grasp the cable during use. Along its length, the cable 44 includes a small loop 50 for fastening such to a retaining hook 52, having an inverted "U" shape, secured to tubular member 24*a*.

The water bottle 14 comprises a collapsible bladder 54 formed of rubber, flexible plastic or other watertight material. The exterior surface of the bladder 54 is provided with a dark color such as gray or black to absorb energy in the form of sunlight and warm water held within the bladder. The bottom of the bladder 54 is provided with a flexible hose 56 having a spraying nozzle 58 at its distal end. A shut-off valve (not shown) may be provided in the hose 56 to regulate liquid flow from the bladder 54 to the nozzle 58.

The bottom end of each leg 22 is positioned in one of the corners of the rectangular floor portion 16 upon which a shower user stands. The floor portion 16 may be formed from any flexible, non-skid, water-resistant, sheet material and includes a bottom wall 60 and a contiguous side wall 62 extending about periphery of the bottom wall. The side wall 62 preferably slopes toward the center of the shower 10 to better support the ends of the legs 22 and shed water therefrom. A one-way spout 64 is provided in the side wall 62 to allow drainage of water from the floor portion 16.

To assist in retaining the side wall 62 in an upright orientation, a plurality of eyelets or metallic rings 66 are secured to the top of the side wall. Each of the rings 66 is positioned at the angled corners of the side wall 62 and is adapted to receive a buttonhead rivet 68, or other suitable article hanger, secured to the lowermost tubular member 24d of each leg 22.

The legs 24*a–d* of the frame 12 are substantially enclosed by the curtain portion 20. The curtain portion 20 includes four trapezoidal panels 70, 72, 74 and 76 of water-resistant fabric, such as nylon, sewn or otherwise joined together in a continuous sheet. All of the panels 70–74 are of substantially the same size, but one panel 76 is preferably bisected into two halves 76*a* and 76*b* along a vertical axis to provide an opening which may be closed by a first zipper 78. A second zipper 80 along the bottom of the curtain portion 20 permits selective attachment thereof to the top of the side wall 62 of the floor portion 16.

A plurality of metallic rings 82 are secured to the top of the curtain portion 20. Each of the rings 82 is positioned at the junctions between the several panels comprising the curtain portion 20. The rings 82 receive buttonhead rivets 84, or other suitable article hangers, secured to the uppermost tubular member 24*a* of each leg 22 to support the curtain portion 20 at a fixed height.

When the user steps onto the bottom wall 60 of the floor portion 16, the added weight assists in anchoring the shower 10 to the ground. When stepping out, however, this particular benefit is lost. Thus, to prevent a gust of wind from upsetting the shower 10, a flexible loop 86 is preferably stitched to the bottom of each curtain panel 70, 72, 74 and 76*a*. The loops 86 permit the shower 10 to be firmly anchored to the ground with conventional stakes 88.

The transparent roof portion 18 is positioned atop the frame 12 and partially overlapping the curtain portion 20 to fully enclose a user of the shower 10. The roof portion 18 is preferably shaped in the form of a four-sided pyramid having a central apex 90. Each of the four sides 92 of the roof portion 18 comprises a relatively thin sheet of transparent and flexible plastic. Preferably, the sides 92 are integrally molded together as a single unit at the time of their manufacture to avoid seams which could weaken and undesirably admit air or precipitation.

When the portable shower 10 is to be used, the floor portion 16 is placed on the ground surface with its peripheral side wall 62 directed upward. The legs 22 are next assembled, connected together by the tubular members 28 and 30, and positioned in each of the corners of the floor portion 16. The rings 66 are positioned over the rivets 68 to support the side wall 62 of the floor portion 16. Then, the solar hot water bottle 14 is filled with water and hung from the eyebolt 32 above the center of the floor portion 16.

The curtain portion 20 is suspended from the frame 12 by positioning the metallic rings 82 over the rivets 84 on the legs 22. By joining the corresponding halves of the zipper 80 together with sliding operator 81 the bottom of the curtain portion 20 is joined to the floor portion 16. If desired, stakes 88 may be positioned through the loops 86 to anchor the shower 10 to the ground. The roof portion 18 is finally located over the top of the frame 12 to isolate the water bottle 14 within the shower and away from cooling winds.

On a day where the temperature is 70 degrees fahrenheit, the water bottle 14 will heat approximately 5 gallons of water initially at 60 degrees fahrenheit to a temperature of 108 degrees fahrenheit in less than three hours. Under the influence of gravity, the sun-warmed water may be discharged through the nozzle 58 onto the body of a user for washing. As the top, bottom and sides of the shower 10 may be fully closed, the user has complete privacy and is also sheltered from breezes, rainfall and the like.

When the shower 10 is not in use, the frame 12 is collapsed by disassembling the various tubular members 24, 28 and 30. After drying, water bottle 14, roof portion 18 and curtain portion 20 are folded and placed along with all of the tubular members on the floor portion 16. The floor portion 16 is then rolled up to retain the remainder of the shower within it for storage in a convenient place like a vehicle trunk.

From the foregoing, it will be noted that a portable shower has been provided which can used essentially anywhere in the outdoors. The shower is easy to assemble for use and, because its parts are relatively lightweight and small in size, may be disassembled for convenient storage. As the interior of the shower may be completely enclosed, it may also be used to store diverse items in the outdoors when required.

While the shower has been described with a high degree of particularity, it will be appreciated by those skilled in the art that numerous modifications may be made thereto. For example, the curtain and floor portions could be suspended from an external frame, rather than an internal frame, as illustrated herein. Further, the frame could have any desired number of legs in excess of three. Therefore, it is to be understood that the present invention is not limited to the sole embodiment described above, but encompasses any and all embodiments within the scope of the following claims.

I claim:

1. A portable shower, comprising:

a self-supporting frame;

a curtain portion supported by said frame and having an opening at the top of said frame;

a waterproof floor portion secured to the bottom of said curtain portion by a zipper; and, a transparent roof portion removably secured over said opening at the top of said frame and being selectively detachable from said curtain portion for preventing precipitation and wind from entering said shower, and said transparent roof portion comprising an inverted bowl having a peripheral bottom edge adapted to overlap, and slidably engage, the top of said curtain portion.

2. The portable shower according to claim 1 wherein said frame comprises:

four upright legs, each of said legs formed of a plurality of detachable tubular members joined in axial alignment with one another; and, a top assembly including a pair of intersecting tubular members secured together at their respective midpoints, each of said intersecting tubular members having downwardly turned end portions for receiving the respective tops of each of said legs.

3. The portable shower according to claim 1 wherein said curtain portion includes a plurality of side panels and a zippered access in one of said side panels.

4. The portable shower according to claim 1 wherein said floor portion includes:

a flexible base wall; and, a flexible side wall extending upwardly from the periphery of said base wall and said side wall secured by said zipper to said curtain portion.

5. The portable shower according to claim 4 further comprising a spout in said side wall.

6. The portable shower according to claim 1 further comprising a collapsible water bottle having a darkened exterior surface for absorbing solar energy, said water bottle being supported by said frame adjacent said opening at the top of said frame.

7. The portable shower according to claim 1 wherein said transparent roof portion is integrally molded from an impermeable thermoplastic material.

8. A portable shower, comprising:

a self-supporting frame;

a curtain portion supported by said frame, said curtain portion defining an opening at the top of said frame;

a waterproof floor portion removably secured to the bottom of said curtain portion for isolating a user of the shower from the adjacent ground surface; and, a transparent and impermeable roof portion removably secured over said opening at the top of said frame whereby a user may selectively remove said transparent roof portion from said opening while bathing for increasing air circulation through said shower, and said transparent and impermeable roof portion comprising an inverted bowl having a peripheral bottom edge adapted to overlap, and slidably engage, the too of said curtain portion.

9. The portable shower according to claim 8 wherein said transparent roof portion is integrally molded from a thermoplastic material.

10. The portable shower according to claim 8 wherein said frame comprises:

four upright legs, each of said legs formed of a plurality of detachable tubular members joined in axial alignment with one another;

a pair of intersecting tubular members extending across said portable shower to diagonally brace such, each of said intersecting tubular members having downwardly turned end portions for receiving the respective tops of each of said legs; and, an eyebolt passing through the respective centers of said intersecting tubular members for connecting said intersecting members.

11. The portable shower according to claim 10 further comprising a collapsible water bottle suspended from said eyebolt.

12. The portable shower according to claim 8 wherein said curtain portion includes a plurality of side panels and a zippered access in one of said side panels.

13. The portable shower according to claim 8 wherein said floor portion includes:

a flexible base wall; and, a flexible side wall extending upwardly from the periphery of said base wall and removably secured to said curtain portion.

14. The portable shower according to claim 13 further comprising a drainage spout in said side wall.

15. A portable shower, comprising:

a self-supporting frame having four upright legs, each of said legs formed of a plurality of detachable tubular members joined in axial alignment with one another, said frame further having a pair of intersecting tubular members connected at their respective midpoints and extending across said portable shower to diagonally brace such, each of said intersecting tubular members having downwardly turned end portions for receiving, respectively, the top of each of said legs;

a flexible, curtain portion positioned about said upright legs thereby providing said frame with an open top;

a flexible, waterproof floor portion removably secured to the bottom of said curtain portion for isolating a user of the shower from the adjacent ground surface; and, a roof portion removably secured over said frame and enclosing said open top, said roof portion being an inverted bowl formed from a thermoplastic material which is flexible, transparent and impermeable, and said roof portion having a peripheral bottom edge adapted to overlap, and slidably engage the top of said curtain portion.

16. The portable shower according to claim 15 further comprising a collapsible water bottle having a darkened exterior surface for absorbing solar energy, said water bottle being supported by said frame adjacent said roof portion.

17. The portable shower according to claim 16 wherein a first zipper removably secures said floor portion to said curtain portion.

18. The portable shower according to claim 17 wherein a second zipper in said curtain portion provides access for a user to the interior of said shower.

* * * * *